US011752526B1

(12) United States Patent
Strickland

(10) Patent No.: US 11,752,526 B1
(45) Date of Patent: Sep. 12, 2023

(54) SHOE SOLE CLEANING DEVICE

(71) Applicant: Ronald L. Strickland, Winter Garden, FL (US)

(72) Inventor: Ronald L. Strickland, Winter Garden, FL (US)

( * ) Notice: Subject to any disclaimer, the term of this patent is extended or adjusted under 35 U.S.C. 154(b) by 645 days.

(21) Appl. No.: 16/703,160

(22) Filed: Dec. 4, 2019

(51) Int. Cl.
*B08B 3/02* (2006.01)
*A47L 23/02* (2006.01)

(52) U.S. Cl.
CPC ..... *B08B 3/02* (2013.01); *A47L 23/02* (2013.01)

(58) Field of Classification Search
None
See application file for complete search history.

(56) References Cited

U.S. PATENT DOCUMENTS

| | | | | |
|---|---|---|---|---|
| 3,737,942 | A * | 6/1973 | Casey | A47L 23/02 15/311 |
| 5,950,269 | A | 9/1999 | Openshaw et al. | |
| 5,964,959 | A * | 10/1999 | Bleth | A47L 23/02 134/182 |
| 6,668,842 | B1 * | 12/2003 | Wilke | A47L 23/02 134/119 |
| 10,750,927 | B1 * | 8/2020 | Nurre | A47L 23/22 |
| 2017/0035267 | A1 * | 2/2017 | Bassiri | A61L 2/18 |
| 2019/0231166 | A1 * | 8/2019 | Anderson | A47L 23/26 |

FOREIGN PATENT DOCUMENTS

| | | | | |
|---|---|---|---|---|
| CN | 108992015 | * 12/2018 | | A47L 23/20 |
| CN | 209450484 | * 10/2019 | | A47L 23/02 |
| KR | 200393029 | * 8/2005 | | A47L 23/02 |
| KR | 20130115047 | * 10/2013 | | G21F 9/30 |
| KR | 101622565 | * 5/2016 | | A61L 2/18 |
| WO | WO20000862823 | * 10/2000 | | A61L 2/10 |

OTHER PUBLICATIONS

KR101622565 English translation, accessed on May 2022. (Year: 2016).*
CN209450484 English translation, accessed on May 2022. (Year: 2019).*
WO20000862823 English translation, accessed on May 2022. (Year: 2000).*
KR200393029 English translation, accessed on May 2022. (Year: 2005).*
CN 108992015 English translation, accessed on May 2022. (Year: 2018).*
KR20130115047 English translation, accessed on May 2022. (Year: 2013).*

* cited by examiner

*Primary Examiner* — Eric W Golightly
*Assistant Examiner* — Arlyn I Rivera-Cordero
(74) *Attorney, Agent, or Firm* — Sanchelima & Associates, P.A.; Christian Sanchelima; Jesus Sanchelima

(57) ABSTRACT

A shoe sole cleaning device is disclosed. The shoe sole cleaning device comprises a housing; a shoe receiving arrangement provided on the housing to receive one or more shoes therein; and a cleaning mechanism comprising a plurality of water jets arranged in the shoe receiving arrangement. The plurality of water jets are adapted to provide water sprays towards bottom of soles of the one or more shoes received in the shoe receiving arrangement for cleaning thereof.

13 Claims, 4 Drawing Sheets

SHOE SOLE CLEANING DEVICE

BACKGROUND OF THE INVENTION

1. Field of the Invention

The present disclosure relates generally to a cleaning apparatus, and particularly relates to a device for cleaning the bottom and sides of a boot or shoe sole.

2. Description of the Related Art

Footwear, such as shoes and boots, collects dirt and debris from use in the outdoors. The simple door mat is provided at most homes and office buildings to provide a means for cleaning the soles of the shoes being worn by people entering the building. Door mats are not very effective at removing dirt and debris, such as grass, snow, sand, etc., embedded in the treads of such shoes. Moreover, over period of time, door mats eventually get dirty and become less effective in removing dirt. Mechanical devices for cleaning footwear have been developed, but have not proven to be effective in both cleaning and sanitizing the bottom and sides of the shoes or boots being cleaned. For example, mechanical cleaners are known that use a brush immersed in water and utilize a part of the brush's rotation for cleaning of the shoes or boots. However, these are not effective to clean dirt and debris stuck to bottom of shoes or boots. Other known systems employ a container, usually in the form of a washing tank, which has some mechanism for creating turbulent flow of water therein, for removing dirt from shoes dipped therein while typically being worn by the user. Such systems are usually bulky boxes designed for special applications, like golf shoes sites, soccer shoes, etc. Moreover, such systems may lead to wastage of large amount of water for cleaning of sole of a single pair of shoes or boots, which is undesirable.

Applicant believes that a related application corresponds to Expired U.S. Pat. No. 5,950,269 ('269 patent) which discloses a sole cleaning device for cleaning the bottoms and sides of the soles of boots and shoes. The device includes a rotating brush mounted above a container of water so that upon rotation of the brush a portion of the brush extends into the water. The device further includes a removable scraper grate for supporting a shoe above the water but in engagement with the brush. A motor for rotating the brush against the sole of the boot is provided. The removable grate provided with a pair of spaced and parallel side rails have fixed brushes mounted to the side rails and facing one another. The removable grate further includes a sieve platform, extending on one side of the grate above the water. Sponges are positioned on top of the sieve for removing water from a boot or shoe placed on the sponge. The device of '269 patent may not be effective to clean dirt and debris stuck to bottom of shoes or boots, such as grass, snow, sand, etc., embedded in the treads of shoes or boots. Moreover, the device of '269 patent may generally be large and unwieldy.

Other documents describing the closest subject matter provide for a number of more or less complicated features that fail to solve the problems described above in an efficient and economical way. None of the documents suggest the novel features of the present invention.

SUMMARY OF THE INVENTION

It is one of the objectives of the present invention to provide a shoe sole cleaning device which provides a safe and non-toxic method to clean soles of shoes.

It is another objective of the present invention to provide a shoe sole cleaning device which has a practical, convenient and durable design for use in homes, offices and public buildings.

It is yet another objective of the present invention to provide a shoe sole cleaning device which is easy to operate, convenient to set-up, carefree of maintenance and inexpensive to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
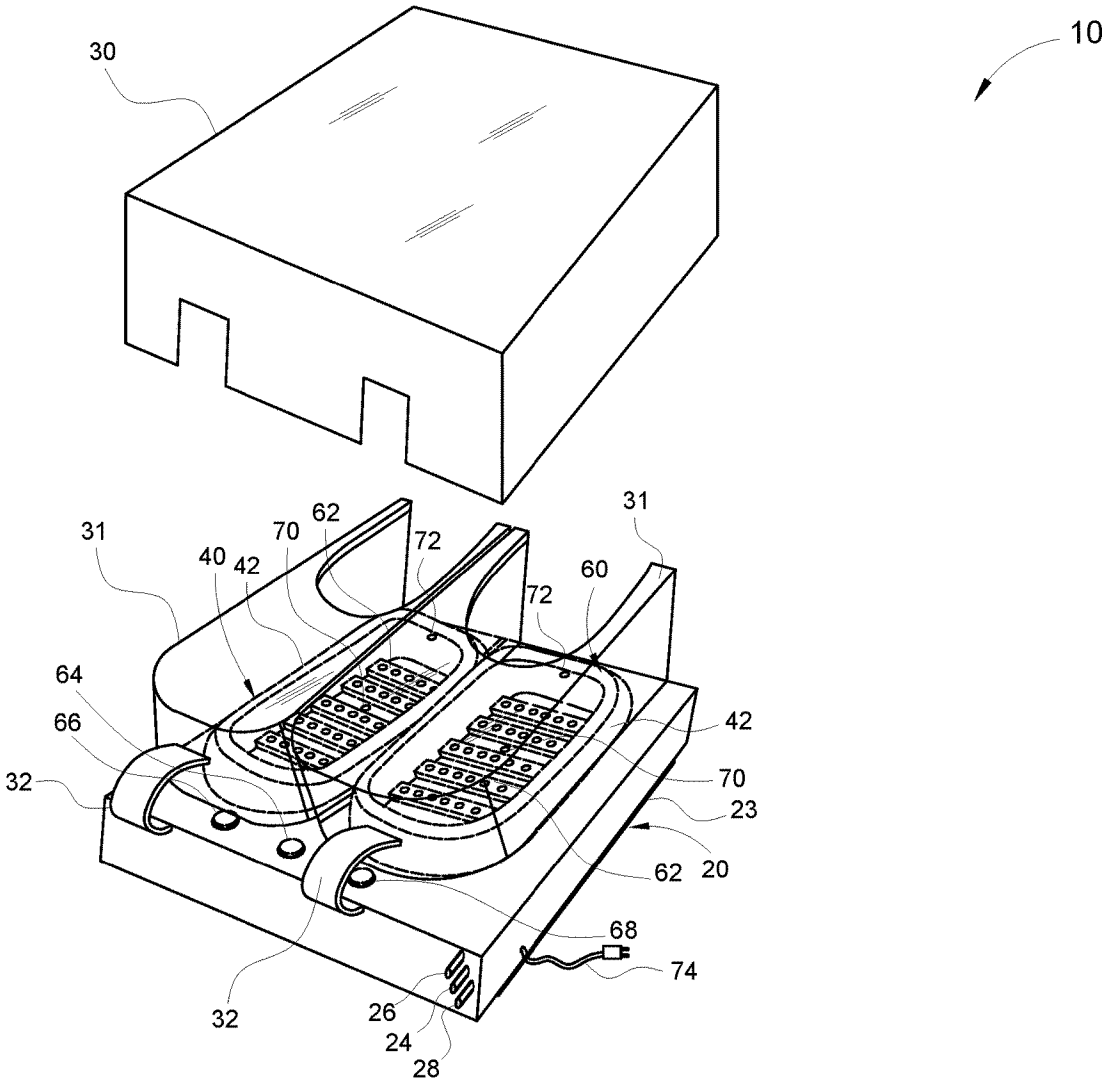
FIG. 1 illustrates a diagrammatic perspective view of shoe sole cleaning device 10 with cover 30 in open state thereof, in accordance with one or more embodiments of the present disclosure.
Figure 2:
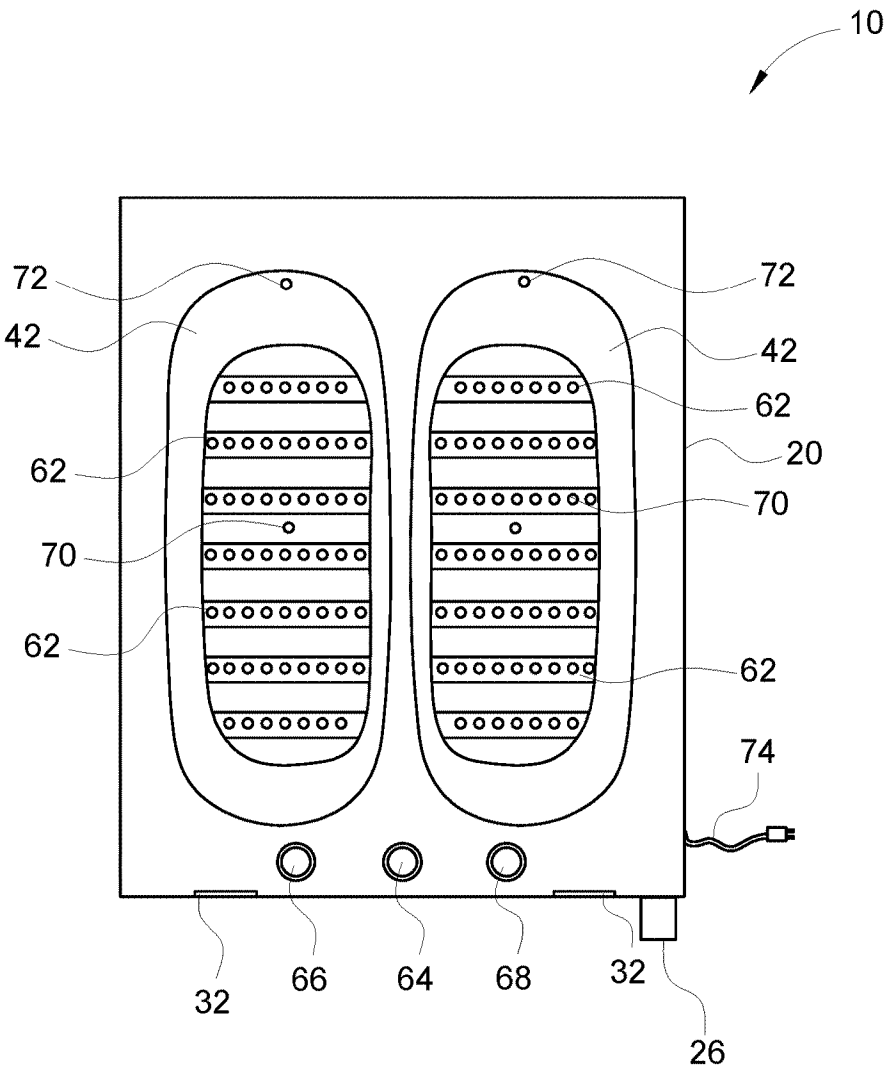
FIG. 2 illustrates a diagrammatic top planar view of the shoe sole cleaning device 10 with the cover 30 and secondary covers 31 removed, in accordance with one or more embodiments of the present disclosure.

Referring to FIGS. 1-4, illustrated are diagrammatic views of a shoe sole cleaning device (generally referred by the numeral 10), in accordance with various embodiments of the present disclosure. Shoe sole cleaning device 10 of the present disclosure is a small, easy-to-use, portable cleaning device, in particular for the cleaning of the recesses in the profiled sole of shoes or boots. Shoe sole cleaning device 10 is designed to remove mud and other heavy debris such as clay from the underside and side portions of a shoe or boot. Shoe sole cleaning device 10 may be adapted and employed for cleaning of regular wear shoes (such as, walking shoes and the like) as well as for relatively heavy footwear (such as, construction boots and the like), as will be made clear from the description in subsequent paragraphs. As illustrated in FIG. 1, shoe sole cleaning device 10 primarily includes a housing 20, a shoe receiving arrangement 40 and a cleaning mechanism 60.

Housing 20 is a generally rectangular frame serving as the base for incorporating various components of shoe sole cleaning device 10. Housing 20 is preferably formed from molded plastic, such as injection molded plastic, to provide a sturdy and durable base for the operation of shoe sole cleaning device 10. Housing 20 of the present design may generally be hollow inside. As illustrated, housing 20 supports shoe receiving arrangement 40 and cleaning mechanism 60 therein. Housing 20 provides a generally flat top surface 22 onto which shoe receiving arrangement 40 is mounted. Further, cleaning mechanism 60 is integrally formed within housing 20. Housing 20 may be provided with a support base 23 which may be located below thereof. Support base 23 may be in the form of a continuous block (similar to or slightly smaller than dimensions of housing 20, as shown) or in the form of discrete support legs. It may be appreciated that support base 23 may provide cushioning to housing 20 to prevent any shocks thereto and may further be implemented for increasing height of housing 20, as and when required.

Housing 20 may include multiple connections or conduits for receiving and removal of water therefrom. In particular, housing 20 includes three connections or conduits, a hose connector 24, a first drain conduit 26 and a second drain conduit 28. Herein, hose connector 24 is utilized for receiving water for cleaning of sole of shoes, for instance from a water source such as a tap or the like. It may be appreciated that hose connector 24 may be disposed in fluid connection with water source via a pipe or the like. Further, first drain conduit 26 and second drain conduit 28 are, respectively, utilized for transporting out and dispensing of dirty water carrying the debris removed from the shoes in the process of cleaning thereof, as received via shoe receiving arrangement 40 and cleaning mechanism 60.

Figure 3:
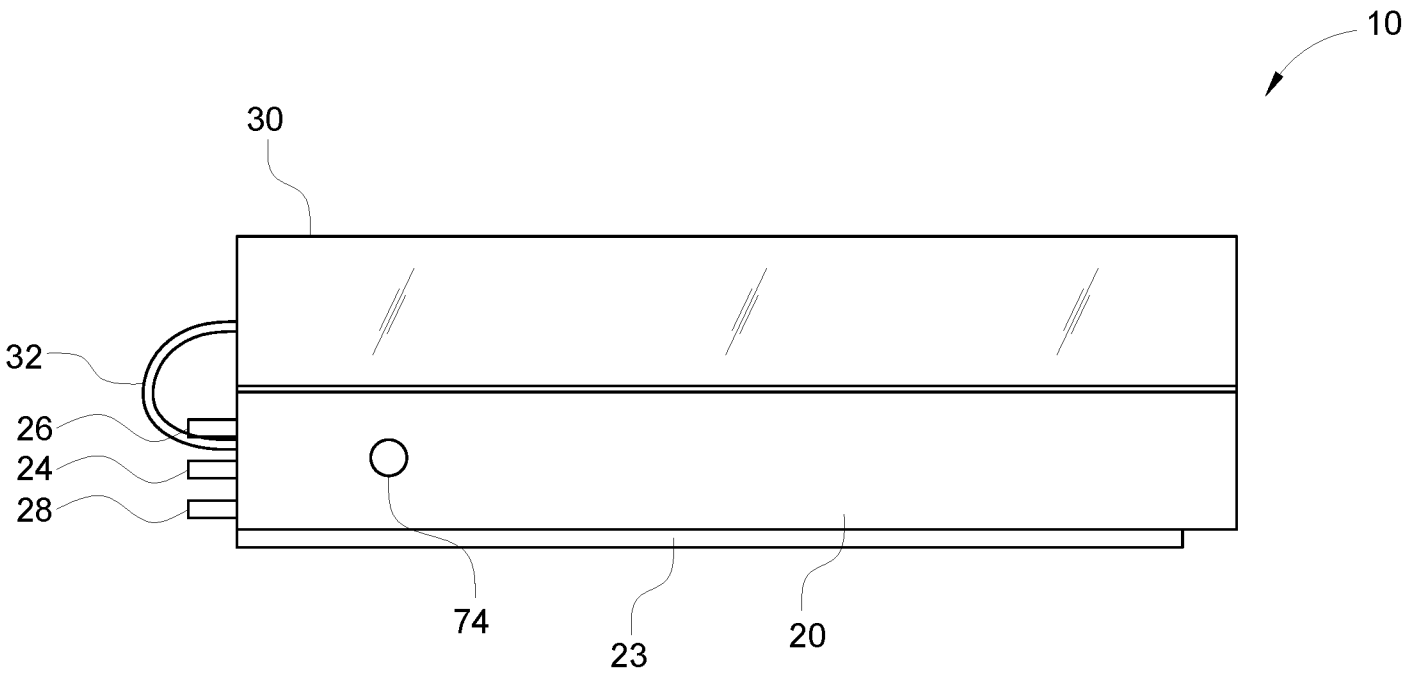
FIG. 3 illustrates a diagrammatic side planar view of the shoe sole cleaning device 10 with the cover 30 in closed state thereof, in accordance with one or more embodiments of the present disclosure.

Further, as illustrated in FIGS. 1 and 3, shoe sole cleaning device 10 includes a cover 30 for housing 20. Herein, cover 30 is generally dimensioned to be similar in size, at least usually have same length and width, as top surface 22 of housing 20. In some examples, housing 20 is dimensioned to be 12 inches long and 16 inches wide, with cover 30 having similar dimensions to provide a proper fit on housing 20. Further, housing 20 may have a height of about 8 inches. Cover 30 can be made of any suitable material, for example, but not limiting to, glass. In present examples, cover 30 is removably coupled to housing 20. Thus, cover 30 can be lifted or placed to be disposed between an open position, as shown in FIG. 1, during operations of shoe sole cleaning device 10, and a closed position, as shown in FIG. 3, when shoe sole cleaning device 10 is not in use. It may be understood that cover 30 when disposed in closed position thereof provides protection to housing 20, especially preventing any debris or dirt from entering cleaning mechanism 60 when shoe sole cleaning device 10 is exposed to outer environment for prolonged periods of time.

Shoe receiving arrangement 40 includes one or more protrusions 42 extending upwards from top surface 22 of housing 20. In the present examples, shoe receiving arrangement 40 is shown to include two such protrusions 42; however, in an alternate embodiment, shoe receiving arrangement 40 may include only one protrusion 42; for instance, for shoe sole cleaning device 10 implemented for cleaning of sole of one shoe or boot at a time. Protrusions 42 are generally made in the shape of a shoe. Protrusions 42 may be oval shaped as to cooperate and accommodate around a shoe of any size. In an alternate embodiment, protrusions 42 inflate and deflate. Protrusions 42 may inflate up until there is sufficient height and seal to prevent spilling of water. In an alternate embodiment, the present invention may be operable without cover 32 as protrusions 42 may prevent water spill sufficiently enough. Once the present invention is not in use then protrusions 42 may deflate to allow for easier storage. As well as to prevent protrusions 42 from being damaged. That is, each of the one or more protrusions 42 is generally sized and shaped to accommodate bottom of a shoe therein. In one or more embodiments, protrusions 42 may be formed along with and as a part of housing 20, for example during molding thereof. Protrusions 42 can be formed of any suitable material, preferably same material as housing 20. In some examples, protrusions 42 are made of silicone material or like, which can somewhat adjust to shape of shoe being received therein. Further, each of protrusions 42 may be disposed in fluid communication with one of drain conduits, i.e. first drain conduit 26 and second drain conduit 28.

Further, shoe sole cleaning device 10 includes secondary covers 31 to enclose protrusions 42 of shoe receiving arrangement 40. Secondary covers 31 are generally formed in the shape of protrusions 42. Secondary covers 31 have cut-outs to allow for the user to place their shoes while wearing them in shoe receiving arrangement 40, while their legs could extend from the cut-outs. It should be understood that secondary covers 31 have sufficient height to allow for shoes of most sizes to be placed within shoe receiving arrangement 40. Further, housing 20 may be provided with hinges 32 located along a front side thereof. Secondary covers 31 may be mounted to housing 20 with hinges 32 on one of two corresponding sides. Thereby, allowing secondary covers 31 to be pivoted to be disposed between the closed position during operations of shoe sole cleaning device 10 and a closed position when shoe sole cleaning device 10 is not in use. Also, cover 30 may be provided with cut-outs to accommodate hinges 32 in the present invention.

Further, cleaning mechanism 60 is implemented for providing jet or stream of water towards bottom of shoes placed in shoe receiving arrangement 40 for cleaning of soles of such shoes. For such purpose, cleaning mechanism 60 includes a plurality of water jets 62. Plurality of water jets 62 may be arranged in a matrix form with multiple rows and each row having multiple water jets 62, inside each of protrusions 42 in shoe receiving arrangement 40. Herein, water jets 62 are located generally at same level as top surface 22 of housing 20. Water jets 62 may be disposed in fluid communication with hose connector 24 to receive water supply for spraying of water therefrom. Such connections may be achieved by means of multiple small channels or feed lines, as may be contemplated by a person skilled in the art. In the present examples, water jets 62 are arranged to generally point upwards for spraying stream of water in upward direction therefrom. Further, waste water collected inside protrusions 42 may be disposed-off via corresponding first drain conduit 26 and second drain conduit 28.

Cleaning mechanism 60 also includes one or more buttons for activation and deactivation of various components thereof. In the present examples, cleaning mechanism 60 may include three buttons, a first button 64, a second button 66 and a third button 68. Herein, first button 64 may be utilized for activation and deactivation of water jets 62 of cleaning mechanism 60. For instance, when user may press first button 64 once, water jets 62 are activated to provide sprays of water therefrom. Further, when first button 64 is pressed again by the user, water jets 62 are deactivated to stop or cease sprays of water therefrom. Second button 66 may be associated with opening and closing of valve of hose connector 24 to allow and stop supply of water to water jets 62. Third button 68 may again be associated with opening and closing of both of first drain conduit 26 and second drain conduit 28 to allow and stop drainage of water respectively from corresponding protrusions 42 of shoe receiving arrangement 40.

In another example, cleaning mechanism 60 may include sensors for automatic operation thereof. In such example, cleaning mechanism 60 may include a pressure switch sensor 70 arranged in each of protrusions 42 of shoe receiving arrangement 40. Herein, pressure switch sensor 70 is in form of an actuation sensor which may be activated by weight of an object placed thereon. Pressure switch sensors 70 may be placed along with water jets 62 in protrusions 42 of shoe receiving arrangement 40. Pressure switch sensors 70 may be configured to activate water jets 62 in cleaning mechanism 60 when an object with more than a predefined weight is placed in corresponding protrusions 42. Further, cleaning mechanism 60 may include a water level sensor 72 arranged in each of protrusions 42 of shoe receiving arrangement 40. Herein, water level sensor 72 may be any of magnetic float type, pneumatic type, conductive type or any suitable type of sensor may be activated by level of water in corresponding protrusion exceeding level of placement thereof. Water level sensors 72 may be placed generally near top edge inside protrusions 42 of shoe receiving arrangement 40. Water level sensors 72 may be configured to open valves associated with corresponding first drain conduit 26 and second drain conduit 28 to remove water from respective protrusion 42, when the water level reaches near top of protrusions 42 so as to avoid overflow therefrom. The present invention may include a power supply 74 to provide electric power for functioning of various components of cleaning mechanism 60.

In above example, cleaning mechanism 60 may also include a controller to coordinate operations thereof in respect of various buttons and sensors. Controller may generally be implemented as a combination of a processor and a memory operatively coupled with each other. Herein, memory may be capable of storing machine executable instructions, and processor may be capable of executing stored machine executable instructions for performing tasks related to the processes of cleaning mechanism 60. Examples of the memory include, but are not limited to, volatile memory devices (e.g., registers, cache, RAM) and/or non-volatile memory devices (e.g., ROM, EEPROM, flash memory, etc.). Processor may be embodied as one or more of various processing devices, such as a multi-core processor, a single core processor, a coprocessor, a microprocessor, a controller, a digital signal processor (DSP), a processing circuitry with or without an accompanying DSP, or various other processing devices including integrated circuits such as, for example, an application specific integrated circuit (ASIC), a field programmable gate array (FPGA), a microcontroller unit (MCU), a hardware accelerator, a special-purpose computer chip, or the like.

Figure 4:
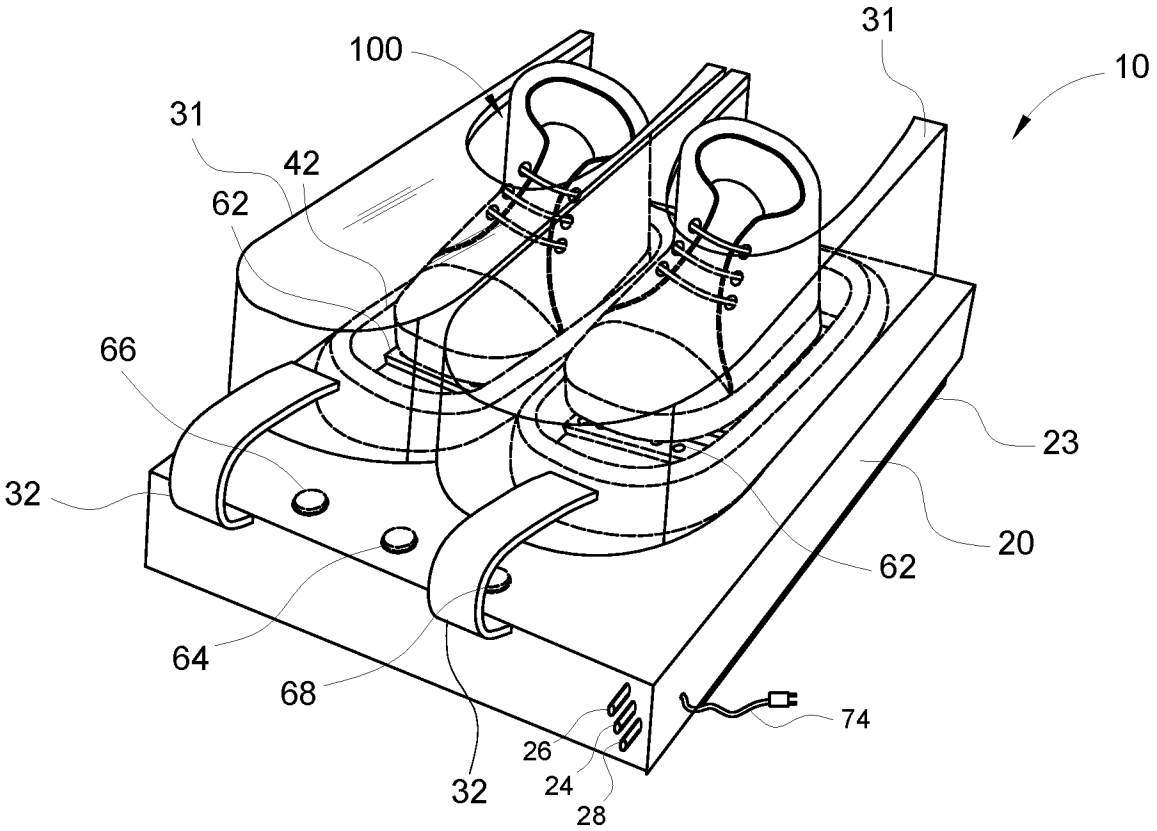
FIG. 4 illustrates a diagrammatic perspective view of the shoe sole cleaning device 10 with the cover 30 and the secondary covers 31 removed, and shoes 100 placed thereon, in accordance with one or more embodiments of the present disclosure.

In operation, as shown in FIG. 4, the user may first remove cover 30 from housing 20. The user may pivot secondary covers 31 to the open position. The user may choose to place his/her shoes 100 (for instance, while being worn on feet thereof) in protrusions 42 of shoe receiving arrangement 40. In some examples, the user may choose to only place one of his/her foot in one of protrusions 42 of shoe receiving arrangement 40, while keeping the other foot outside on dry ground. As a result of user placing his/her shoes 100 in protrusions 42, pressure switch sensors 70 may get activated due to weight of corresponding shoe 100 placed thereon. Pressure switch sensors 70 may activate water jets 62 to cause high pressure water sprays directed towards bottom and sides of soles of shoes 100, thus resulting in cleaning thereof. If water level in one or both protrusions 42 exceed a certain predefined height, corresponding water level sensor(s) 72 may get activated and cause to open respective drain conduit(s) 26, 28 to release water therefrom and prevent overflow of water in shoe sole cleaning device 10. Further, in case of one or more sensors 70, 72 not working for any reason, the user may also choose to manually operate cleaning mechanism 60. For this purpose, the user may step-on first button 64 and second button 66, to release supply of water from hose connector 24 and turn on water jets 62. When the user may be finished with both shoes 100, the user can turn off water jets 62 by stepping again on step-on first button 64 and further third button 68 to discard dirty water via first drain conduit 26 and second drain conduit 28.

In some examples, housing 20 may include a tank or a container or the like to hold water for supplying to water jets 62 in cleaning mechanism 60. Further, shoe sole cleaning device 10 may include a motor unit or the like to pump water for supplying water to water jets 62 for release of high pressure water spray therefrom. Alternatively, water jets 62 may be connected to a source of water under pressure for applying high pressure water spray streams to shoes 100 to be cleaned. In other examples, shoe sole cleaning device 10 may rely on gravity feed of water for generating enough pressure for water streams exiting from water jets 62. In some examples, pressure switch sensors 70 may be in the form of springs which provide resistance to downward pressure that opens the valve controlling the flow of water to water jets 62, for example in response to downward pressure exerted by the placement of shoes 100 thereon. In some examples, a flow of sanitizing fluid can be directed into the water stream released from water jets 62 to be applied to the bottom of the shoes 100 being cleaned. In some examples, cover 30 may have a central opening for insertion of a foot with shoe worn thereon, the opening being located in an upper portion of cover 30, and being continued through a part of upper face, where its rearward extremity is rounded, and top face of cover 30 is raised in a dome-like outward protuberance, to accommodate the instep of a shoe. Such cover 30 may confine high pressure water streams during operation of present shoe sole cleaning device 10 and prevent spillage of water to outside thereof, thus preventing wetting of clothes of user trying to clean worn shoes (such as, shoes 100) placed inside shoe receiving arrangement 40.

Shoe sole cleaning device 10 can remove grass, snow, and dirt embedded into the treads of shoes, such as shoes 100. The dirt and debris removed from the shoes being cleaned is removed from the shoe sole cleaning device 10 without reengaging the shoes being cleaned. Shoe sole cleaning device 10 provide effective and superior shoe cleaning ability without resorting to complex operation or construction. A door mat or welcome mat can be used in conjunction with shoe sole cleaning device 10 to help remove any remaining dirt from shoes 100 which may already have been loosened up by water spray. Shoe sole cleaning device 10 of the present disclosure can be located next to an entryway or the like, generally to be utilized before passing through the entryway, and is employed for removal of debris from the bottom and sides of a person's shoes before passing through the entryway. The shoe sole cleaning device 10 is intended to be positioned on a flat surface outside the entryway into a building or positioned outside any entryway that is located inside the building. The entryway could be any door or entrance into a residential structure, such as house, tent, or RV, or into a commercial or industrial building. Shoe sole cleaning device 10 could also be utilized at a location inside a building where dirt and/or germs from shoes are desired to be cleaned or sanitized from the shoes before entering a cleaner area (e.g., a garage to living area in the house, workshop to living area in the house, manufacturing area to office area in an industrial setting, etc.). The shoe sole cleaning device 10 is preferably disposed at a location that is convenient to access and proximate to the entryway to be able to affect a cleaning of footwear before passing through the entryway. Another typical installation of the present shoe sole cleaning device 10 would be at a construction site. Shoe sole cleaning device 10 could be used to prevent workers from tracking dirt into the building after interior floors have been installed. Another possible installation would be at outdoor parks to prevent patrons from soiling the interiors of their cars when returning from a hike. Numerous other uses of shoe sole cleaning device 10 of the present invention will become apparent to one familiar with the art.

It is to be understood that shoe sole cleaning device 10 is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of shoe sole cleaning device 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A system for a shoe sole cleaning device, comprising:

a housing, said housing is a rectangular frame with straight sides configured to support a shoe receiving arrangement and a cleaning mechanism therein said receiving arrangement is disposed upon a top planar surface of the housing to receive one or more shoes therein, said shoe receiving arrangement further includes one or more protrusions extending upwards from said top planar surface, said one or more protrusions is oval to completely receive soles of the one or more shoes therein;

the cleaning mechanism including a plurality of water jets arranged in the shoe receiving arrangement, wherein the plurality of water jets is adapted to provide water sprays towards bottoms of soles of the one or more shoes received in the shoe receiving arrangement for cleaning thereof; and secondary covers pivotally connected to the housing to be disposed between an open position and a closed position to allow for enclosing the shoe receiving arrangement, said secondary convers are made of a transparent material, each of said secondary covers present cut-outs having an U shape extending from a rear side thereof towards a front side thereof a predetermined distance, each of said secondary covers is a single solid element that, at a base thereof, conforms with the shape of the one or more protrusions.

2. The system of claim 1 further including a pressure switch sensor arranged in the one or more protrusions of the shoe receiving arrangement proximal to a center thereof, wherein the pressure switch sensor is configured to activate the corresponding water jets of the cleaning mechanism to provide water sprays, when a shoe is received in the one or more protrusions.

3. The system of claim 1 further including a support base disposed on a bottom surface of the housing, said housing being greater in length than a length exhibited by the support base.

4. The system of claim 1, wherein the secondary covers are pivotally connected to the housing by means of hinges, said hinges are located on a front side of the housing and are separated by a predetermined distance.

5. The system of claim 1 further including a cover removably mounted to the housing, said cover is internally hollow in order to cover the shoe receiving arrangement, on a front side the cover presents slots that are aligned with the location of the hinges so that when the cover is mounted the hinges are received by said slots.

6. The system of claim 1, wherein said plurality of water jets are disposed in horizontal arrangements defining rows that are separated by a predetermined distance from each other.

7. The system of claim 1 further includes a power supply disposed at a lateral side of the housing, said power supply is configured to provide electric power for functioning of the cleaning device.

8. The system of claim 1 further including a hose connector to be connected to a water source for receiving water for the cleaning mechanism, said hose connector is located on a front side of the housing.

9. The system of claim 8 further including a first drain conduit and a second drain conduit for transporting out and dispensing of water from the cleaning mechanism, said hose connector is disposed between said first drain conduit and said second drain conduit.

10. The system of claim 1 further including a water level sensor arranged in each of the one or more protrusions of the shoe receiving arrangement near a top edge thereof, wherein the water level sensor is configured to open valves associated with a first drain conduit and a second drain conduit to remove excess water from the one or more protrusions, when the water level reaches near top of the one or more protrusions.

11. The system of claim 10 further including a first button to be manually pressed to activate and deactivate the plurality of water jets of the cleaning mechanism, said button is disposed upon said top planar surface proximal to a front side of the housing.

12. The system of claim 11 further including a second button to be manually pressed to cause opening and closing of a valve associated with a hose connector to allow and stop supply of water to the plurality of water jets of the cleaning mechanism, said second button is disposed at a lateral side of the first button.

13. The system of claim 12 further including a third button to be manually pressed to cause opening and closing of both of the first drain conduit and the second drain conduit to allow and stop drainage of water respectively from the one or more protrusions of the shoe receiving arrangement, said third button is disposed at a lateral side of the first button opposite to the second button so that the first button is located between said second button and said third button, wherein the first button, the second button and the third button are equidistant from each other and are disposed in a horizontal arrangement.

* * * * *